US008567310B2

(12) United States Patent
Yi

(10) Patent No.: US 8,567,310 B2
(45) Date of Patent: Oct. 29, 2013

(54) ELECTRIC HAND-HELD BINDING APPARATUS

(76) Inventor: Xiaojie Yi, Tongxiang (CN)

( * ) Notice: Subject to any disclaimer, the term of this patent is extended or adjusted under 35 U.S.C. 154(b) by 217 days.

(21) Appl. No.: 13/003,750

(22) PCT Filed: Jul. 13, 2009

(86) PCT No.: PCT/CN2009/072735

§ 371 (c)(1),
(2), (4) Date: Jan. 11, 2011

(87) PCT Pub. No.: WO2010/006543

PCT Pub. Date: Jan. 21, 2010

(65) Prior Publication Data

US 2011/0120322 A1 May 26, 2011

(30) Foreign Application Priority Data

Jul. 17, 2008 (CN) ..... 2008 2 0127625 U
Aug. 13, 2008 (WO) ..... PCT/CN2008/071976
Apr. 22, 2009 (CN) ..... 2009 2 0151787 U

(51) Int. Cl.
*B65B 13/00* (2006.01)

(52) U.S. Cl.
USPC ..... 100/6; 100/31; 140/119; 140/93.2; 140/93.6; 140/118; 140/149; 140/57

(58) Field of Classification Search
USPC ..... 100/31, 6; 140/119, 93.2, 93.6, 118, 140/149, 57
See application file for complete search history.

(56) References Cited

U.S. PATENT DOCUMENTS 4,865,087 A * 9/1989 Geiger ..... 140/119
5,279,336 A * 1/1994 Kusakari et al. ..... 140/57
5,558,134 A * 9/1996 Miyazaki ..... 140/57
5,605,180 A 2/1997 Tange et al.
7,398,800 B2 * 7/2008 Kusakari et al. ..... 140/118
7,493,925 B2 * 2/2009 Bae ..... 140/123.6

(Continued)

FOREIGN PATENT DOCUMENTS

CN 119014 A 9/1995
CN 1688481 A 10/2005

(Continued)

OTHER PUBLICATIONS

International Search Report for International Application No. PCT/CN2009/072735 dated Oct. 29, 2009.

*Primary Examiner* — Dana Ross
*Assistant Examiner* — Mohammad Nourbakhsh
(74) *Attorney, Agent, or Firm* — Patterson & Sheridan, L.L.P.

(57) ABSTRACT

An electric hand-held binding apparatus according to embodiments including a wire feeding device configured to convey the binding wire. The binding apparatus further includes a twisting device including a twisting shaft, a fork disposed on an end of the twisting shaft, a twisting shaft spur gear disposed on the shaft, and a twisting shaft bevel gear. The twisting device is configured to wrap an object with the binding wire. The binding apparatus further includes a cutoff device configured to cut the binding wires. In the binding apparatus, the twisting shaft spur gear includes a groove on a surface in contact with the twisting shaft bevel gear, and the twisting shaft bevel gear includes a pillar configured to slide in the groove so that a rotation of the driving wire-feeding wheel shaft is desynchronized relative to a rotation of the twisting shaft.

8 Claims, 5 Drawing Sheets

(56) References Cited

U.S. PATENT DOCUMENTS

| | | | | |
|---|---|---|---|---|
| 2006/0011254 | A1 | 1/2006 | Yokochi et al. | |
| 2007/0000555 | A1 * | 1/2007 | Kim | 140/119 |
| 2010/0313991 | A1 | 12/2010 | Nagaoka et al. | |

FOREIGN PATENT DOCUMENTS

| | | | |
|---|---|---|---|
| CN | 1768188 | A | 5/2006 |
| CN | 201232363 | Y | 5/2009 |
| WO | 2008013142 | A1 | 1/2008 |

* cited by examiner

ELECTRIC HAND-HELD BINDING APPARATUS

TECHNICAL FIELD

This utility model relates to a hand-held binding device, in particular to an electric hand-held binding apparatus applicable to the binding of steel bars.

BACKGROUND ART

Hand-held binding machines usually mean small binding tools that can be held with hands by operators in binding operations. Corresponding to different objects to be bound, there are steel bar binding machines used to bind steel bars and agricultural binding machines used to bind tree branches. The working mechanism of these binding machines is: to wrap the object with iron wires or other binding wires by many rounds in order to tie the object.

Take the steel bar binding machines as an example to describe electric hand-held binding apparatus. There are many structures for the realization of steel bar binding machines. According to its principles, the structure of the most commonly-used steel bar binding machines is mainly divided into a controller used to control the entire binding machine, a wire-feeding device, a twisting device, a cutoff device, the first electric motor connected to the wire-feeding device, the second electric motor connected to the twisting device and the cutoff device, and the headpiece, switch, and power supply respectively connected to the wire-feeding device, twisting device, and cutoff device. The wire-feeding device usually comprises a material feeding used to hold binding wire, a wire-feeding channel, and a transmission device used to carry the binding wires from the material feeding device to the through-hole in the headpiece through the wire-feeding channel. The twisting device comprises a twisting head and a twisting head used to form binding wires around the steel bars, drive the twisting head to rotate, and thus twist the binding wires.

Existing biding machines mainly have the following technical problems:

Existing binding machines have complicate structures. Many of them need two electric motors to realize the binding functions. The body of the binding machine is large, heavy, and difficult to carry. Heavy and big binding machines are especially inconvenient for their operators.

CONTENTS OF THE UTILITY MODEL

The technical problems to be solved by this utility model include the heavy weight and large-size of existing biding machines that which make them difficult to carry and inconvenient for operators.

An electric hand-held binding apparatus is disclosed in the present application.

The electric hand-held binding apparatus according to embodiments comprises a wire feeding device including a wire disc configured to hold binding wire, a driving wire-feeding wheel rotatable about a driving wire-feeding wheel shaft, a driven wire-feeding wheel meshed with the driving wire-feeding wheel, and a wire-feeding bevel gear disposed on the driving wire-feeding shaft, wherein the wire feeding device is configured to convey the binding wire from the wire disc to a headpiece.

The electric hand-held binding apparatus further comprises a twisting device including a twisting shaft having an axis of rotation perpendicular to an axis of rotation of the driving wire-feeding wheel, a fork disposed on an end of the twisting shaft and at least partially within the headpiece, a twisting shaft spur gear disposed on the shaft, and a twisting shaft bevel gear disposed on the shaft and meshed with the wire-feeding bevel wheel, wherein the twisting device is configured to wrap an object with the binding wire.

The electric hand-held binding apparatus further comprises a cutoff device configured to cut the binding wires that are wrapped around the object to be bound, and an electric motor configured to supply power to the wire-feeding device, the twisting device, and the cutoff device.

The electric hand-held binding apparatus further comprises a motor shaft gear disposed on an output shaft of the electric motor and meshed with the twisting shaft spur gear. The electric hand-held binding apparatus further comprises a first single-direction bearing disposed between the driving wire-feeding wheel and the driving wire-feeding wheel shaft, the first single-direction bearing being configured to permit the driving wire-feeding wheel to rotate in only one direction. The electric hand-held binding apparatus further comprises a second single-direction bearing between the twisting shaft spur gear and the twisting shaft, the first single-direction bearing being configured to permit the driving wire-feeding wheel to rotate in only one direction.

In the electric hand-held binding apparatus, the twisting shaft spur gear includes a groove on a surface in contact with the twisting shaft bevel gear, and the twisting shaft bevel gear includes a pillar configured to slide in the groove so that a rotation of the driving wire-feeding wheel shaft is desynchronized relative to a rotation of the twisting shaft.

This utility model is meant to achieve the following effects:

First, this utility model uses two single-direction bearings and all kinds of transmission devices to interlock the wire-feeding device and twisting device, so that only one electric motor is needed and the weight and volume of the other electric motor can be removed.

Second, a number of small parts such as spur gears and bevel gears are used for the wire-feeding device and the twisting device in this utility model, and the designed structure of the utility model is very ingenious. It is a practical, small, lightweight, easy-to-carry, and easy-to-operate product created by the applicant through numerous experiments and research & development tests. On the other hand, this product will significantly improve the work efficiency of steel bar binding and reduce the work load of the operators.

Figure 1:
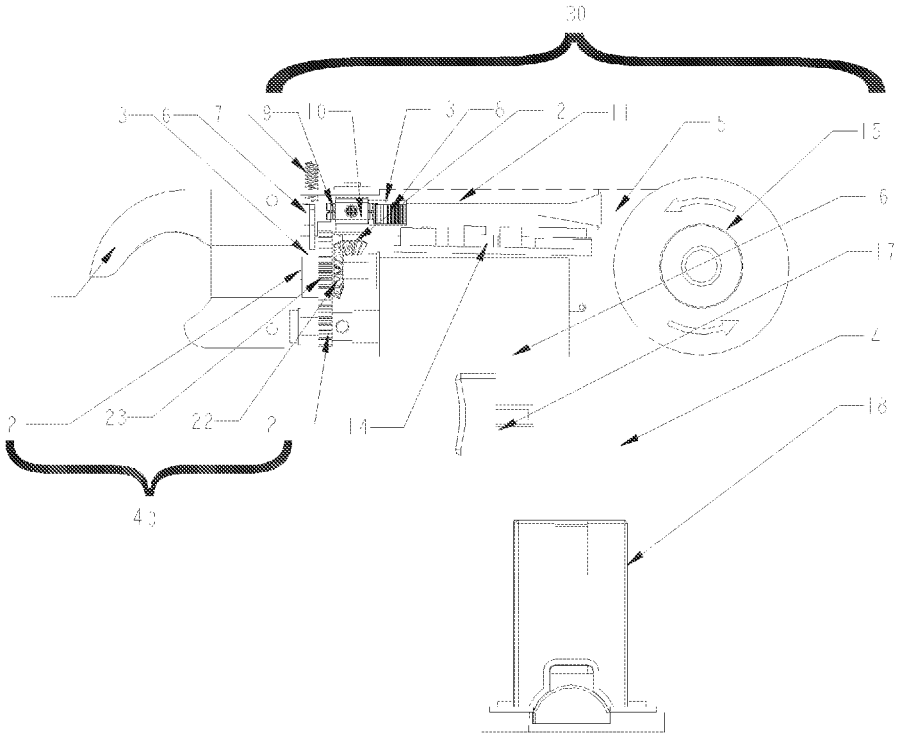
FIG. 1 is the schematic view of the internal structure of an embodiment of this utility model.
Figure 2:
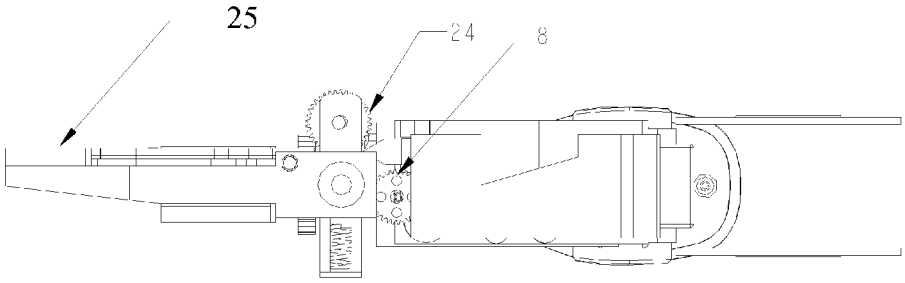
FIG. 2 is the top view of the internal structure of an embodiment of this utility model.
Figure 3:
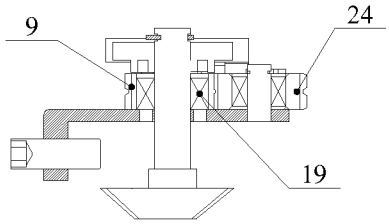
FIG. 3 is a cross-section detail of a portion of a wire-feeding device.
Figure 4:
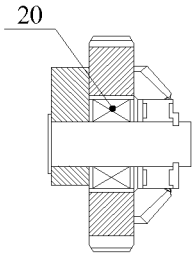
FIG. 4 is a cross-section detail of a portion of a cutoff device.
Figure 5:
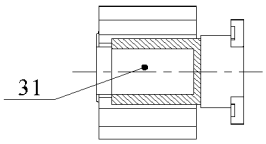
FIG. 5 is a cross-section detail of a portion of a twisting device.
Figure 6:
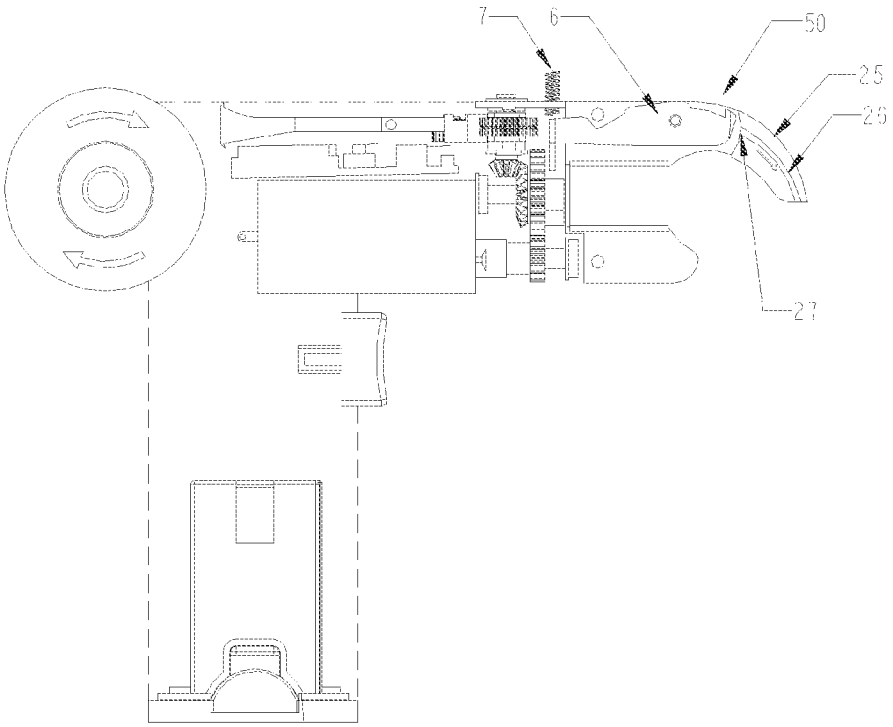
FIG. 6 is the schematic view of the internal structure of an embodiment of the cutoff device of this utility model.

Wherein: 1—Headpiece; 2—Twisting shaft; 3—Cam; 6—Wire cutter; 7—Spring; 8—Counter wheel; 9—Wire-feeding wheel; 10—Wire wheel stand; 11—Wire guide tube; 12—Stem bevel gear; 13—Wire guide taper pipe; 14—Circuit board; 15—Wire disc; 16—Motor; 17—Switch; 18—Battery; 19—Single-direction bearing A; 20—Single-direction bearing B; 21—Shaft gear of motor; 22—Bevel gear of twisting shaft; 23—Spur gear of twisting shaft; 24—Driven wire-feeding wheel; 25—Wire guide block; 26—Wire guide through-hole; 27—Wire cutting groove; 23—Arc groove; 29—Convex pillar; 31—U-shaped fork; 32—Convex point

DETAILED DESCRIPTION OF THE UTILITY MODEL

This utility model will be described in detail with the attached drawings.

This utility model discloses an electric hand-held binding apparatus, comprising a headpiece, a wire-feeding device, and cutoff device, and further comprises:

An electric hand-held binding apparatus according to embodiments comprises a wire feeding device including a wire disc configured to hold binding wire, a driving wire-feeding wheel rotatable about a driving wire-feeding wheel shaft, a driven wire-feeding wheel meshed with the driving wire-feeding wheel, and a wire-feeding bevel gear disposed on the driving wire-feeding shaft, wherein the wire feeding device is configured to convey the binding wire from the wire disc to a headpiece.

The electric hand-held binding apparatus further comprises a twisting device including a twisting shaft having an axis of rotation perpendicular to an axis of rotation of the driving wire-feeding wheel, a fork disposed on an end of the twisting shaft and at least partially within the headpiece, a twisting shaft spur gear disposed on the shaft, and a twisting shaft bevel gear disposed on the shaft and meshed with the wire-feeding bevel wheel, wherein the twisting device is configured to wrap an object with the binding wire.

The electric hand-held binding apparatus further comprises a cutoff device configured to cut the binding wires that are wrapped around the object to be bound, and an electric motor configured to supply power to the wire-feeding device, the twisting device, and the cutoff device.

The electric hand-held binding apparatus further comprises a motor shaft gear disposed on an output shaft of the electric motor and meshed with the twisting shaft spur gear. The electric hand-held binding apparatus further comprises a first single-direction bearing disposed between the driving wire-feeding wheel and the driving wire-feeding wheel shaft, the first single-direction bearing being configured to permit the driving wire-feeding wheel to rotate in only one direction. The electric hand-held binding apparatus further comprises a second single-direction bearing between the twisting shaft spur gear and the twisting shaft, the first single-direction bearing being configured to permit the driving wire-feeding wheel to rotate in only one direction.

In the electric hand-held binding apparatus, the twisting shaft spur gear includes a groove on a surface in contact with the twisting shaft bevel gear, and the twisting shaft bevel gear includes a pillar configured to slide in the groove so that a rotation of the driving wire-feeding wheel shaft is desynchronized relative to a rotation of the twisting shaft.

An embodiment of the steel bar binding machine is used to describe this utility model below. However, this embodiment shall not be considered as limiting this utility model.

As shown in FIG. 1-FIG. 11, this utility model comprises C-shaped Headpiece 1, a handle 4, a housing 5 and Electric Motor 16 set up inside the housing, Battery 18, a wire-feeding device 30, a twisting device 40, and a cutoff device 50.

Motor Shaft Gear 21 is set up on the output shaft of Electric Motor 16. Electric Motor 16 is connected to Battery 18 in the handle 4 through Switch 17.

Said wire-feeding device 30 comprises a Wire Disc 15 used to rotate the wrapping wire connected to the inner wall of the housing 5, Driving and Driven Wire-feeding Wheels 9 and 24 that are mutually meshed, Wire Guide Pipe 11, and Wire Guide Block 25. Ring-shaped wire-feeding grooves that match the diameter of the iron wires are set up on the outer circumferential surfaces of Driving and Driven Wire-feeding Wheels 9 and 24. A Wire-feeding Bevel Gear Wheel 12 facing downward is set up on the lower end of the driving wire-feeding wheel shaft. A Single-direction Bearing 19 is set up between Driving Wire-feeding Wheel 9 and the driving wire-feeding wheel shaft. Wire Guide Pipe 11 is set up between Wire Disc 15 and the meshing point between Driving and Driven Wire-feeding Wheels 9 and 24. A Wire Guide Taper Pipe 13 is set up on the tail end of Wire Guide Pipe 11. Wire Guide 25 is set up on the upper arc of Headpiece 1 and has an arc-shaped Wire Guide Through-hole 26. The iron wire goes through Wire Guide Pipe 11, the ring-shaped wire-feeding grooves on Driving and Driven Wire-feeding Wheels 9 and 24, and arc-shaped Wire Guide Through-hole 26 on Wire Guide Block 25, one after another.

The twisting device 40 comprises Twisting Shaft 2, Twisting Shaft Spur Gear 23, and Twisting Shaft Bevel Gear 22. One end of Twisting Shaft 2 is connected to the middle of the headpiece and perpendicular to the driving wire-feeding wheel shaft. Twisting Shaft Spur Gear 23 and Twisting Shaft Bevel Gear 22 are set up on the other end of Twisting Shaft 2, and Twisting Shaft Spur Gear 23 is set up on the outer side of Twisting Shaft 2. Twisting Shaft Bevel Gear 22 is meshed with Wire-feeding Bevel Wheel 12. Twisting Shaft Spur Gear 23 is meshed with Motor Shaft Gear 21. The end surface of Twisting Shaft 2 in the headpiece has a U-shaped Fork 31 along the axial direction.

Figure 7:
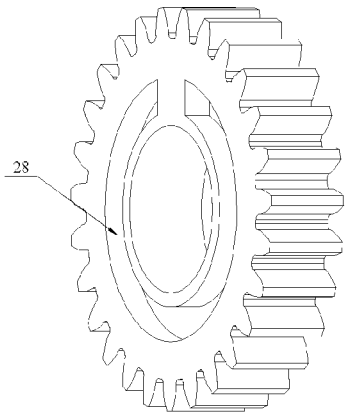
FIG. 7 is the schematic view of an embodiment of the twisting shaft spur gear structure of this utility model.
Figure 8:
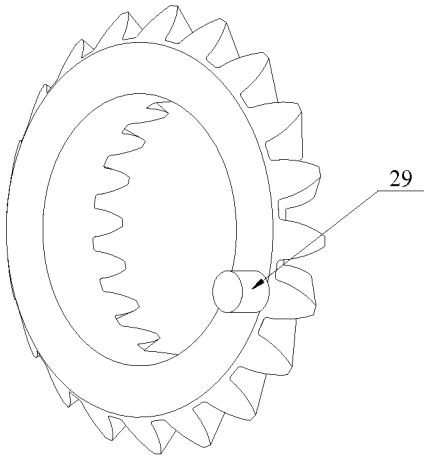
FIG. 8 is the schematic view of an embodiment of the twisting bevel gear structure of this utility model.

As shown in FIG. 7 and FIG. 8, An Arc-shaped Concave Groove 28 is set up on Twisting Shaft Spur Gear 23 on the contact surface between Twisting Shaft Spur Gear 23 and Twisting Shaft Bevel Gear 22. A cylindrical Convex Pillar 29 is set up on Twisting Shaft Bevel Gear 22. Said Convex Pillar 29 is inserted into an Arc-shaped Concave Groove 28 and slides along this Arc-shaped Concave Groove 28. When Twisting Shaft Spur Gear 23 rotates clockwise, it does not drive Twisting Shaft Bevel Gear 22 to rotate until Twisting Shaft Spur Gear 23 turns 350° and Convex Pillar 29 reaches the end of Arc-shaped Concave Groove 28. The main function of this device is to desynchronize the returning motion of the U-shaped fork of Twisting Shaft 2 and the wire-feeding motion and keep the wire-feeding motion of the wire-feeding wheel earlier than the returning motion of the twisting shaft to ensure that the iron wire goes through the middle of the U-shaped fork during the wire feeding process.

Said cutoff device 50 comprises a Wire Cutter 6 and a Convex Wheel 3. Said Wire Guide Block 25 and wire guide plate has a Wire-cutting Groove 27 perpendicularly connected to Wire Guide Through-hole 26. The blade of Wire Cutter 6 is set up inside said Wire-cutting Groove 27, and Wire Cutter 6 is hinged to the housing of Headpiece 1. Convex Wheel 3 is sheath-connected to Twisting Shaft 2 between Twisting Shaft Spur Gear 23 and the headpiece. A Single-direction Bearing 20 is set up between Convex Wheel 3 and Twisting Shaft 2. The outer surface of Convex Wheel 3 is butted to the tail end of Wire Cutter 6. With the rotation of Convex Wheel 3, the blade of Wire Cutter 6 moves into and out of Wire-cutting Groove 27 on Wire Guide Block 25. The blade of Wire Cutter 6 moving into and out of Wire-cutting Groove 27 on Wire Guide Block 25 mainly means that the blade moves in Wire-cutting Groove 27 between Wire Guide Block 25 and the wire guide plate.

It also comprises a Counter Wheel 8 set up on the top of the driving wire-feeding wheel shaft. A counting sensor is set up on Counter Wheel 8. Counter Wheel 8 is optional.

It also comprises a Spring 7. Both ends of Spring 7 are butt-connected to the tail end and frame of Wire Cutter 6.

Figure 9:
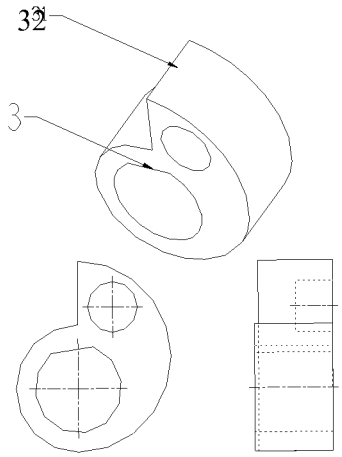
FIG. 9 is a schematic view of the cam structure of this utility model.
Figure 10:
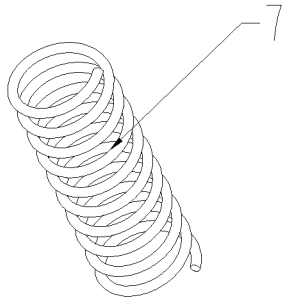
FIG. 10 is an example of the spring structure.
Figure 11:
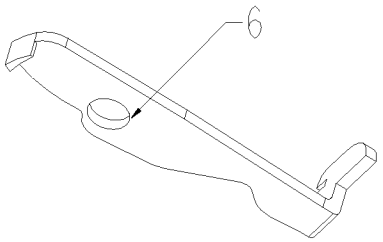
FIG. 11 is an example of the wire cutter.

FIG. 9 is an example of the structure of Convex Wheel 3. Convex Wheel 3 comprises a Convex Point 32. Please refer to FIG. 9. Springing devices such as Spring 7 are used to return Wire Cutter 6 to its original position. Spring 7 is set up on the tail end of Wire Cutter 6. With the rotation of Twisting Shaft 2, Convex Point 32 of Convex Wheel 3 rises and jacks the tail end of Wire Cutter 6. Wire Cutter 6 moves like a level with the anchor point of the head piece as the pivot. The blade of Wire Cutter 6 turns downward. When Convex Wheel 3 moves to the position of Convex Point 31, it cuts off the iron wire and moves on. After it passes the position of Convex Point 31, the tail end of Wire Cutter 6 is driven by Spring 7 to elevate the blade and thus returns to its original position to unblock the wire outlet.

The working process of this utility model is as follows:

Load Wire Disc 15 carrying iron wires into the back of the gun, put the iron wire through Wire Guide Taper Pipe 13 of Wire Guide Pipe 11, and put the iron wire into the ring-shaped wire guide groove between Driving Wire-feeding Wheel 9 and Driven Wire-feeding Wheel 24. Hook the object to be bound with Headpiece 1 and press Start Button 17. The micro-controller on Circuit Board 14 will send work instructions upon receiving the startup signal. Electric Motor 16 rotates clockwise and drives Twisting Shaft Spur Gear 23 via Motor Shaft Gear 21. A Single-direction Bearing 20 is set up between Twisting Shaft Spur Gear 23 and Twisting Shaft 2. Friction force will be generated between Single-direction Bearing 20 and Twisting Shaft 2. This friction force is utilized to turn Twisting Shaft 2 forward. Convex Wheel 3 fixed to the twisting shaft moves with it. U-shaped Fork 31 on the front end of Twisting Shaft 2 returns to the horizontal forward position. At this point Single-direction Bearing 20 idles due to the external resistance. Therefore Twisting Shaft 2 stops turning. Twisting Shaft Spur Gear 23 keeps driving Twisting Shaft Bevel Gear 22 and Wire-feeding Bevel Gear Shaft 12. Wire-feeding Bevel Wheel 12 and Wire-feeding Bevel Gear Shaft 12 form a whole. Single-direction Bearing 19 on the wire-feeding gear shaft rotates forward to drive Driving Wire-feeding Wheel 9 and Driven Wire-feeding Wheel 24 sheath-connected to Single-direction Bearing 19 to mesh and rotate. Wire Wheel Stand 10 and a spring are set up between both wire-feeding wheels. Both wire-feeding wheels are closed meshed via the spring to ensure that the iron wire moves forward out of the arc-shaped Wire Guide Through-hole 26 on Wire Guide Block 25, goes through the U-shaped fork on Twisting Shaft 2, and circles the object to be bound by 360° to form an iron wire ring. When the needed iron wire rings are completed, Driving and Driven Wire-feeding Wheels 9 and 24 have rotated n circles and sent n signals to the micro-controller on Circuit Board 14 via the Hall sensor on Counter Wheel 8. Upon receiving a numerical signal converted from the preset length of iron wires, the micro-controller sends a command for Electric Motor 16 to rotate anticlockwise. Motor Shaft Gear 21 drives Twisting Shaft Spur Gear 23 to rotate. Single-direction Bearing 20 also drives Twisting Shaft 2 to rotate. Although Twisting Shaft Bevel Gear 22 and the wire-feeding gear shaft are also driven, the iron wire will stop moving forward because Single-direction Bearing 19 on the top of the wire-feeding gear shaft idles to interrupt power transmission, and thus stops Driving Wire-feeding Wheel 9. While Twisting Shaft 2 rotates backward, the arc-shaped side surface of Convex Wheel 3 on Twisting Shaft 2 jacks the tail end of Wire Cutter 6 to turn it with the hinged point of the wire cutter as the pivot, so that the wire cutter can cut off the iron wire at the front outlet of the wire guide plate. Spring 7 is set up at the tail end of Wire Cutter 6 and is used to return Wire Cutter 6 to its original position. At the same time U-shaped Fork 31 at the front end of Twisting Shaft 2 twists the iron wire rings inside the fork so that they firmly tighten the object to be bound. During the tightening process, the torque of the motor significantly increases and so does the current. When the desired tightness is reached, the current sensor will send a signal and the micro-controller will immediately send a shut-down command to reset the system. Then the motor will stop running, the current work cycle is completed, and the system is ready for the next working procedure.

It should be noted that the steel bar binding machine may have no counting function. In this case we can manual send a command to the micro-controller on Circuit Board 14. Upon receiving this command, the micro-controller will control the electric motor to rotate backward.

Headpiece 1 is set up at the front end of this device. A U-shaped Fork 31 is set up in the middle of Headpiece 1. U-shaped Fork 31 is used to twist and tighten the iron wires. Twisting Shaft 2 is sheathed by Single-direction Bearing B20. Single-direction Bearing B20 is sheathed by Twisting Shaft Spur Gear 23. Twisting Shaft Bevel Gear 22 is set up on the right of Twisting Shaft Spur Gear 23. The other end of Twisting Shaft 2 is fixed to the body of the machine via a normal bearing. Twisting Shaft Spur Gear 23 is meshed with Motor Shaft Gear 12 at its lower end. Twisting Shaft Bevel Gear 22 is meshed with the bevel gear on the wire-feeding gear shaft. Driving Wire-feeding Wheel 9 is set up on the upper end of the wire-feeding gear shaft. Driving Wire-feeding Wheel 9 is meshed with Driven Wire-feeding Wheel 24. During operation, iron wires pass between Driving Wire-feeding Wheel 9 and Driven Wire-feeding Wheel 24. A Counter Wheel 8 is set up on Driving Wire-feeding Wheel 9. A Hall sensor is set up on Counter Wheel 8. This Hall sensor is used to count the circles that Driving Wire-feeding Wheel 9 has turned.

A Wire Disc 15 is set up at the end of the machine. Wire Disc 15 is wrapped with iron wires. Wire Guide Pipe 11 leads wires to Driving Wire-feeding Wheel 9 and Driven Wire-feeding Wheel 24. A Wire Guide Taper Pipe 13 is set up at the font end of Wire Guide Pipe 11. A Battery 18 is installed inside the handle of the gun and supplies service power.

The invention claimed is:

1. An electric hand-held binding apparatus comprising:

a wire feeding device including a wire disc configured to hold binding wire, a driving wire-feeding wheel rotatable about a driving wire-feeding wheel shaft, a driven wire-feeding wheel meshed with the driving wire-feeding wheel, and a wire-feeding bevel gear disposed on the driving wire-feeding shaft, wherein the wire feeding device is configured to convey the binding wire from the wire disc to a headpiece;

a twisting device including a twisting shaft having an axis of rotation perpendicular to an axis of rotation of the driving wire-feeding wheel, a fork disposed on an end of the twisting shaft and at least partially within the headpiece, a twisting shaft spur gear disposed on the shaft, and a twisting shaft bevel gear disposed on the shaft and meshed with the wire-feeding bevel wheel, wherein the twisting device is configured to wrap an object with the binding wire;

a cutoff device configured to cut the binding wires that are wrapped around the object to be bound;

an electric motor configured to supply power to the wire-feeding device, the twisting device, and the cutoff device;

a motor shaft gear disposed on an output shaft of the electric motor and meshed with the twisting shaft spur gear;

a first single-direction bearing disposed between the driving wire-feeding wheel and the driving wire-feeding wheel shaft, the first single-direction bearing being configured to permit the driving wire-feeding wheel to rotate in only one direction; and a second single-direction bearing between the twisting shaft spur gear and the twisting shaft, the first single-direction bearing being configured to permit the driving wire-feeding wheel to rotate in only one direction; wherein the twisting shaft spur gear includes a groove on a surface in contact with the twisting shaft bevel gear, and the twisting shaft bevel gear includes a pillar configured to slide in the groove so that a rotation of the driving wire-feeding wheel shaft is desynchronized relative to a rotation of the twisting shaft.

2. The electric hand-held binding apparatus according to claim 1, wherein the headpiece includes a wire guide block having an arc-shaped hole configured to shape the binding wire into a circle.

3. The electric hand-held binding apparatus according to claim 2, wherein:

the cutoff device comprises:

a wire cutter connected to the headpiece at a hinge-point, and a convex wheel disposed around the twisting shaft between the twisting shaft spur gear and the headpiece, an outer surface of the convex wheel contacting a tail end of the wire cutter so that a blade of the wire cutter is configured to moves in and out of a wire-cutting groove in the headpiece as the convex wheel rotates.

4. The electric hand-held binding apparatus according to claim 1, wherein the twisting head comprises a U-shaped fork.

5. The electric hand-held binding apparatus according to claim 1, further comprising:

a counter wheel disposed on the driving wire-feeding wheel shaft; and a counting sensor is set up on the counter wheel.

6. The electric hand-held binding apparatus according to claim 1, wherein the groove is an arc extending 350° on the surface of the twisting shaft spur gear.

7. The electric hand-held binding apparatus according to claim 3, further comprising a spring in contact with the wire cutter and configured to return the wire cutter to its original position after cutting.

8. The electric hand-held binding apparatus according to claim 3, further comprising:

a spring disposed on the tail end of the wire cutter, wherein, as the twisting shaft rotates, the convex point of the convex wheel pivots the wire cutter about the hinge-point causing the blade to move down the blade cutting groove to cut the binding wire, and when the convex point of the convex wheel moves past the wire cutter, the spring urges the blade up the blade cutting groove.

* * * * *